US010428551B1

(12) United States Patent
Bloomfield

(10) Patent No.: US 10,428,551 B1
(45) Date of Patent: Oct. 1, 2019

(54) FENCE TRIM GUARD

(71) Applicant: Charles Bloomfield, Sevierville, TN (US)

(72) Inventor: Charles Bloomfield, Sevierville, TN (US)

( * ) Notice: Subject to any disclaimer, the term of this patent is extended or adjusted under 35 U.S.C. 154(b) by 235 days.

(21) Appl. No.: 15/450,623

(22) Filed: Mar. 6, 2017

(51) Int. Cl.
*E04H 17/06* (2006.01)

(52) U.S. Cl.
CPC ..... *E04H 17/063* (2013.01)

(58) Field of Classification Search
CPC .... A01G 9/28; A01G 13/0256; A01K 15/006; A01K 15/04; A01M 21/00; E01F 15/0469; E04H 17/063
USPC ..... 256/1, 32; 52/102
See application file for complete search history.

(56) References Cited

U.S. PATENT DOCUMENTS 3,515,373 A 6/1970 Abbe
3,713,624 A * 1/1973 Niemann ..... E04H 17/063 256/1
4,478,391 A * 10/1984 Kovach ..... E04H 17/063 256/1
4,548,388 A * 10/1985 Cobler ..... E04H 17/063 256/1
4,595,175 A 6/1986 Kauffman
4,903,947 A * 2/1990 Groves ..... E04H 17/063 256/32
4,964,619 A * 10/1990 Glidden, Jr. ..... E04H 17/063 256/32
5,178,369 A * 1/1993 Syx ..... E04H 17/063 256/32
5,328,156 A 7/1994 Hoke
5,377,447 A * 1/1995 Fritch ..... A01G 9/28 52/102
5,769,562 A * 6/1998 Jones ..... A01G 9/28 404/7
6,527,255 B2 * 3/2003 O'Berry ..... E04H 17/063 256/1
6,561,491 B2 * 5/2003 Thompson ..... E04H 17/063 256/1
6,931,798 B1 * 8/2005 Pocai ..... A01G 9/28 256/1
7,004,458 B1 * 2/2006 Grubba ..... E04H 17/063 256/1
7,434,788 B2 * 10/2008 Foster ..... A01K 3/00 256/1
9,313,956 B2 * 4/2016 Volin ..... A01G 9/28
2003/0160224 A1 * 8/2003 Damon ..... E04H 17/063 256/19
2009/0165372 A1 * 7/2009 Smart ..... A01G 9/28 47/33

(Continued)

OTHER PUBLICATIONS

Sex Bolts & Mating Fasteners. Accurate Manufactured Products Group. Indianapolis, IN. 2014. p. 1-3. Retrieved from the Internet: <URL: https://issuu.com/ampg.com/docs/2012-ampg-matingfast>.*

*Primary Examiner* — Josh Skroupa
(74) *Attorney, Agent, or Firm* — Lawrence J. Gibnet, Jr.

(57) ABSTRACT

The device is comprised of two panels in the shape of "L"s that are interwoven with each other when they are placed on the sides of a fence. The device is secured to the ground through a series of holes for that purpose. Additionally, an expander has been placed on the section of the device, both vertical and horizontal, to address the issue of uneven terrain.

5 Claims, 13 Drawing Sheets

(56) References Cited

U.S. PATENT DOCUMENTS

2010/0200823 A1* 8/2010 Ringus ..... E04H 17/063
256/1

* cited by examiner

FENCE TRIM GUARD

A. FIELD OF THE INVENTION

This device relates to preventing grass from growing along a fence area in order to decrease time associate with the yardwork (clipping and trimming) that is typically involved in maintaining a home. The device can also be used to prevent animals from burrowing under fencing and this would be particularly helpful on farms or residential areas.

B. PRIOR ART

The Rooney US Patent Publication 2014/0245660 teaches a flat weed guard for a fence which is intended to be a barrier between the fence and the surrounding grass. The Rooney device will allow the plurality of perforations to proceed the fence post and a plurality of anchoring segments that are to be placed in the ground.

Another representative example can be found at Kauffman U.S. Pat. No. 4,595,175, which utilizes a fence liner intended to prevent weeds grass and other vegetation from growing near the bottom portion of the fence. Both the Rooney and Kauffman references seek to address the problems addressed in this application, however they are materially different from the current application.

Another prior art reference can be found at Abbe U.S. Pat. No. 3,515,373 which discloses a fence trim guard and this also allows for posts to be placed to the trim and into the ground.

A final representative example in the prior art can be found at Hoke U.S. Pat. No. 5,328,156, which is a device that attaches to the bottom of a chain-link fence with friction. In the present invention there are spike holes and the application of the device is secure to the ground in that manner as well as a plurality of ribs on the underside of the device to prevent movement of the base pieces. Furthermore, the present invention teaches an upright portion that attaches directly to the fence.

BRIEF SUMMARY OF THE INVENTION

In order to prevent weeds from growing around fence material this device will have two essential components: a first base member and a second base member. Each of the base members are placed adjacent to the fence and have a flat surface as well as a vertical surface.

There are several different embodiments to securing the base members to achieve the stated goal of preventing weed growth and animal escape. Additionally, there are specific parts that are designed to cover the fence posts to achieve the stated goals as well.

Each of the base members extend a predetermined distance away from the fence as well as a predetermined distance above the ground surface. This extension away from the fence should be sufficient so that the homeowner can use a lawnmower over the device without striking the fence. The two base members may be secured to one another or secured to the fence itself with clips that are provided on the respective vertical members.

On the flat surface a plurality of holes is provided for spikes or stakes to aid in securing the base members to the ground. The device may also have ribs on the bottom of the base members to prevent the device from shifting and to provide drainage areas. A variety of different means to secure the base members to the ground may alternatively or additionally be implemented.

As the two base members are aligned on opposite sides of the fence, the piece for securing the two sections are also aligned. The two members may be secured with a plurality of bolts and nuts or it may be through a plurality of snaps through a plurality of corresponding openings. Additionally, one of the horizontal base members may be comprised of a slightly longer member that will be inserted into a corresponding insert on the other base member.

On the bottom surface of each base piece will be a plurality of ribs which are slightly raised from the surface. This prevents the individual sections from moving as well as provide additional stability and additional space for water drainage through the device. In order to secure the sections to the ground, a plurality of slits or openings is provided on each of the base members; the securement of the base members may be altered depending on the ground surface e.g. grass, dirt or concrete. In this manner, the homeowner can simply secure this device using a spike or other means to secure the individual base members.

With regard to openings around fence end posts and line posts, there will be separate sections for end posts and a separate section for line posts. Each of the sections for end posts and line posts will have a curved portion surround a portion of either the end post or line post. A mating portion will also be provided around the end post to encapsulate the fence post.

With regard to line posts, which are typically on one side of a fence, a curved portion that extends partially around the line post is provided. The section covering the line post may connect to the fence itself or to another corresponding section on the other side of the fence.

At the end of the fence there will also be separate members that will accommodate when the fence ends. There will be two base members which extend beyond a predetermined distance beyond the end of the fence.

NUMBERING DESCRIPTION

1—Fence
2—Line post
3—End post
5—Device
10—First horizontal Member
10*v*—First vertical member
12*a*—First line post base
12*b*—Second line post base
14*a*—First end post base
14*b*—Second end post base
15—Hole
16—Spike Hole
17*a*—Line post base section
17*b*—End post base section
17*c*—Rectangular base section
17*d*—Circular base section
20—Second Base Member
20*v*—Vertical member
25—Ribs
28—Attachment means
29—Snap
30—Nut
31—Bolt
32—Hinge and Rod Connection
40—Slot
41—Tab
60—Single base member
61—Vertical Member
62—Strip
70—Expander

DETAILED DESCRIPTION OF THE EMBODIMENTS

This device 5 is intended to surround the bottom area of a fence 1 so that yard maintenance can be reduced. The fence itself is not being claimed but is integral to the device.

A pair of two base members, a first base 10 and a second base 20 are provided and will attach on opposite sides of the fence 1. Each of the base members, 10 and 20 will be comprised of a flat horizontal section and an integral vertical member 10*v* and 20*v* respectively.

Figure 1:
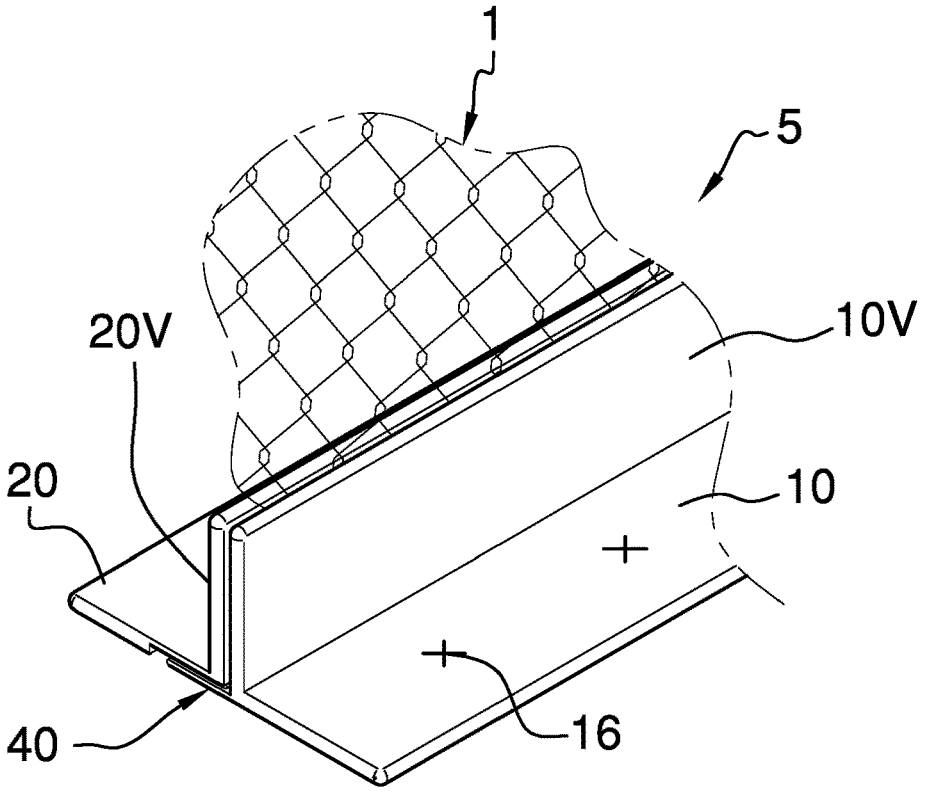
FIG. 1 is an isometric view of the base members and the fence.
Figure 2:
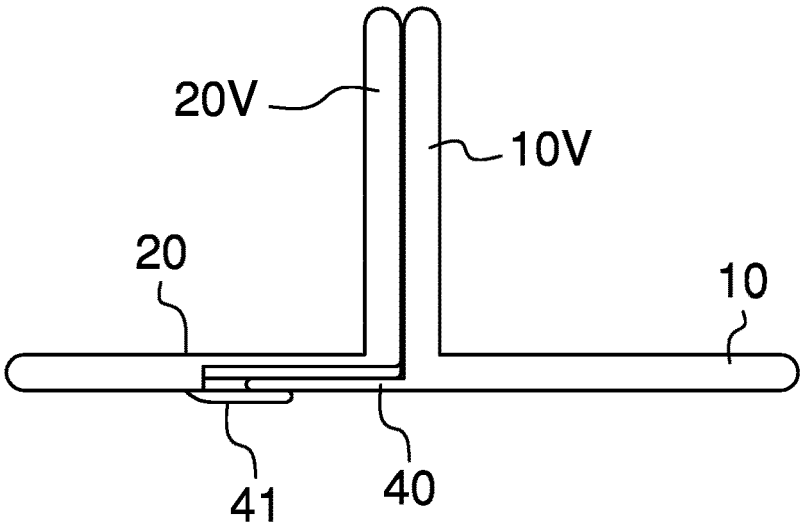
FIG. 2 is a side view of the base members without the fence showing the approximate alignment of the sections when the device is installed.

When the device is surrounding the bottom of the fence such as depicted in FIG. 1, the horizontal sections of the base members will cover the ground surface and each of the horizontal sections will extend outward from the fence a predetermined distance. The distance that the horizontal portion will extend away from the fence should be long enough to enable the homeowner to maintain his or her lawn without impacting the fence and prevent animals from burrowing under the fence. Because the horizontal sections cover the ground surface, grass and other weeds cannot grow under each of the horizontal sections. Additionally, each of the vertical sections, 10*v* and 20*v*, will extend upward from the ground surface along the bottom of the fence a predetermined distance. The exact length of each of the vertical sections is determined to insure that the base members are secured to each other along the fence line without detracting from the cosmetic appeal of the device. The height of the vertical members should also be high enough to prevent the growth of weeds between the vertical sections.

The vertical sections may connect to each other with a bolt 31 and nut 30 connection. Additionally, as an alternative to the bolt 31 and nut 30 there may be a prod, which will attach to a corresponding snap. It is anticipated that other connection mechanisms may alternatively or additionally be utilized by one of ordinary skill in the art to attach the two base members together.

On the outside of each of the base members will be a series of spike holes 15, which are also depicted in FIG. 1. The spike holes 15 are oriented in a cross to permit the homeowner to secure this device into the ground surface with a spike. Unlike if a hole was provided, the cross orientation of the spike holes also prevent grass or weeds from growing through the device 5 when a spike is not inserted.

First Embodiment

In the first embodiment, the bottom of base member 20 will be a plurality of raised ribs 25, which will give added stability and integrity of the device. The plurality of ribs 25 will also allow for draining after the device 5 is installed. When the device is installed, the ribs 25 will not be visible, but will also prevent the sections from moving as the sections are impacted by any lawn maintenance equipment. Base member 20 also provides a tab 41 that is placed periodically along the base member's bottom below the plurality of ribs 25.

Figure 5:
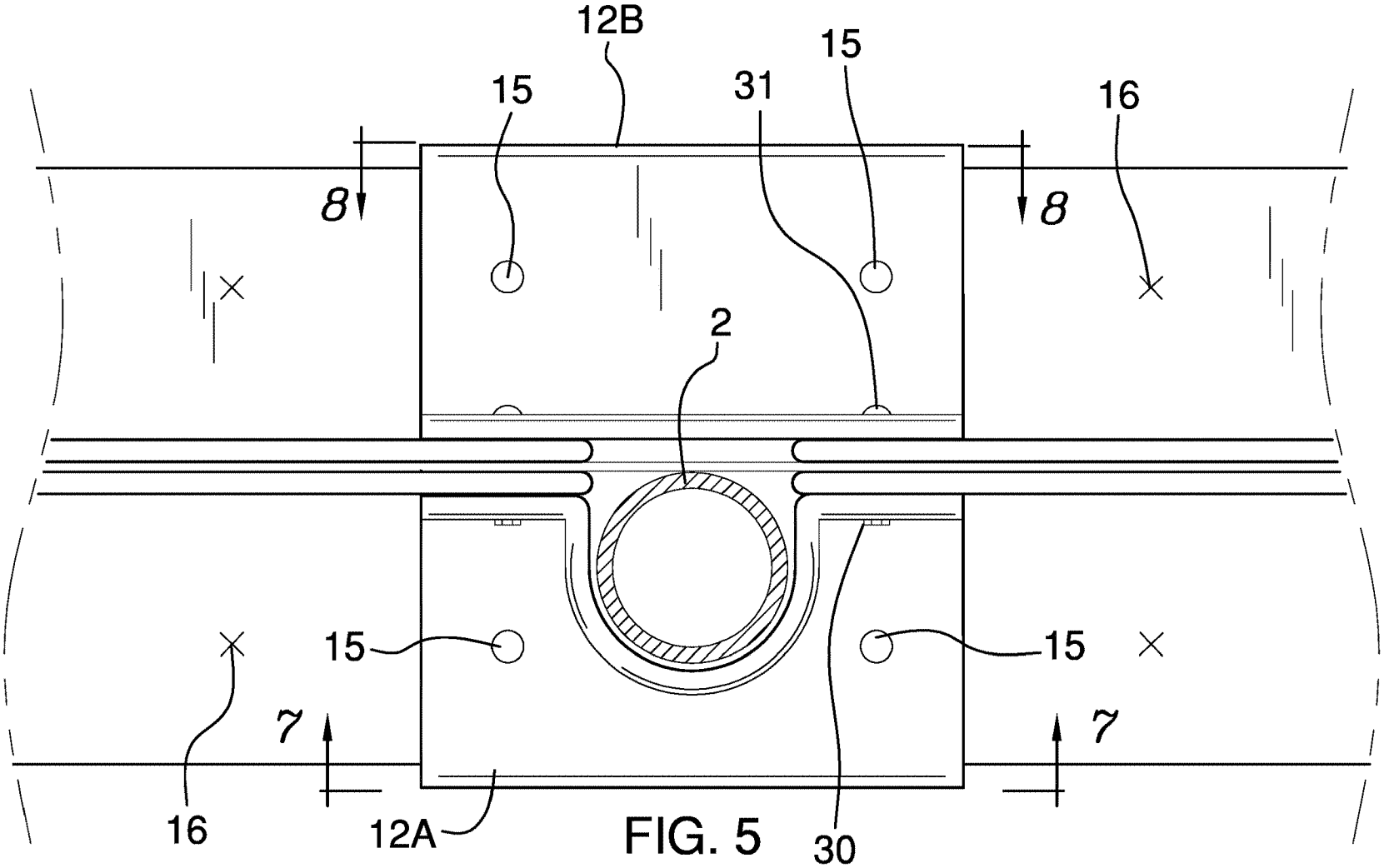
FIG. 5 is a top view of the base members and top line post sections that are surrounding a fence line post.

Because fencing will include a plurality of fence posts there must be special pieces to surround the individual fence post such as depicted in FIG. 5. In FIG. 5, the post base is provided with a curved member which will correspond to the curve in a line fence post. This is important because line posts are secured to one side of a fence.

Figure 3:
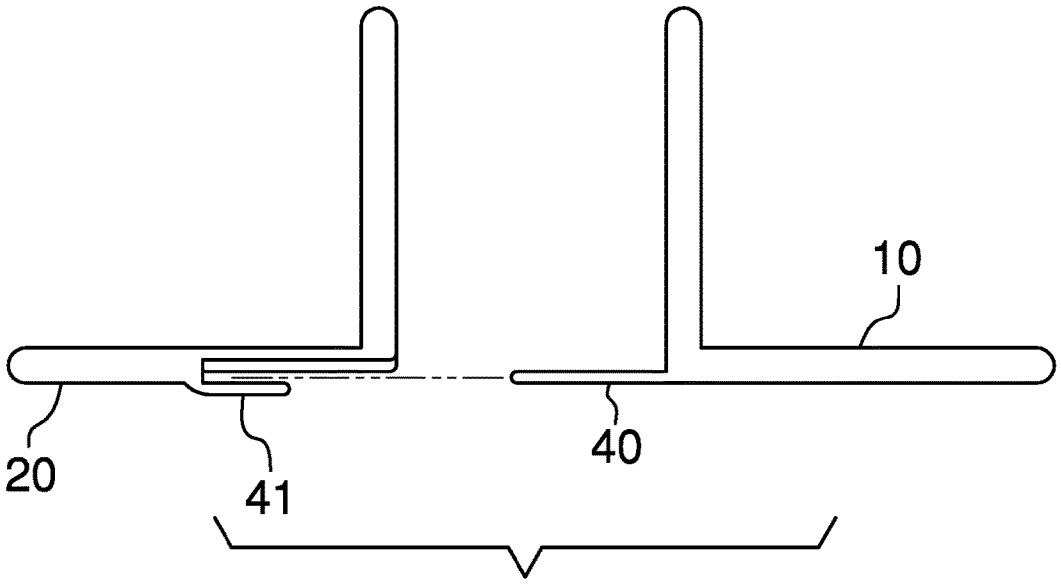
FIG. 3 is an exploded view of the base members showing the approximate alignment of each base member.
Figure 4:
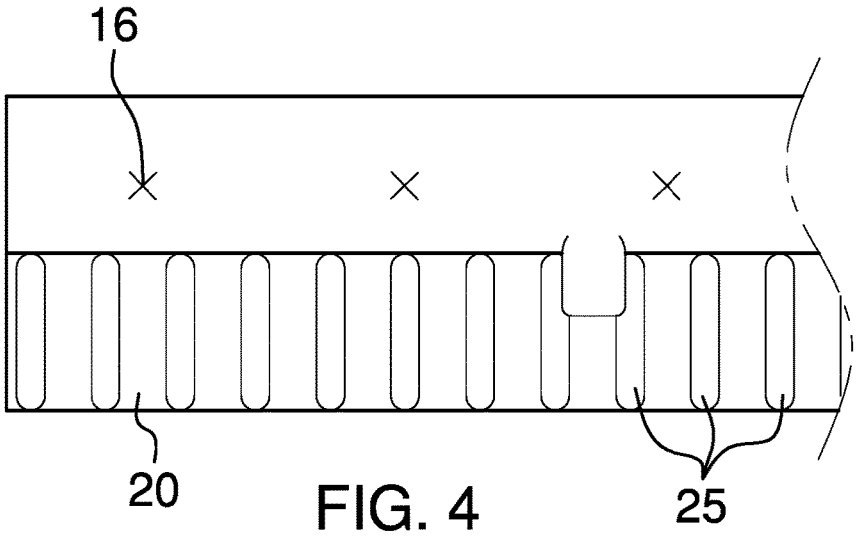
FIG. 4 is a bottom view of the second base member showing a plurality of ribs that have been placed on the underside of the base member and a plurality of cross-slits.

The base member 10 will have a slot 40 that will extend a predetermined distance from the horizontal portion 10 that will extend away from the fence such as depicted in FIG. 3. On the corresponding base member 20, a lip that will envelope a portion of the slot 40 is provided. When the two base members are connected the slot 40 will be inserted between the plurality of ribs 25 and tab 41. This will allow for water to drain along the slot 40 through the gaps between the plurality of ribs 25 and provide additional stability and strength to the device.

Second Embodiment

Figure 13:
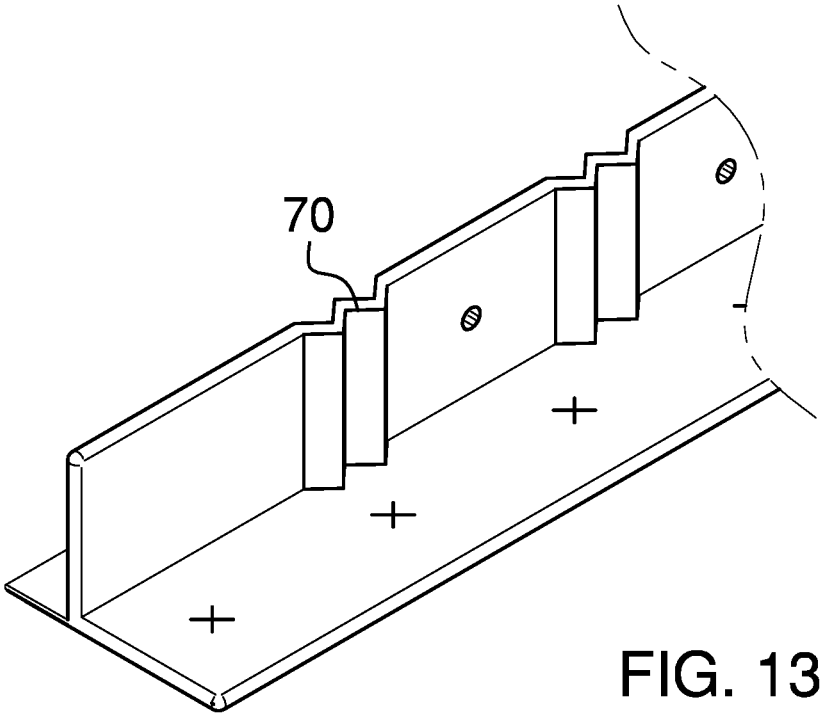
FIG. 13 is a fragmented isometric view of the front side of a base member of a first alternative embodiment, which allows the base member to lie flat over curved ground.
Figure 14:
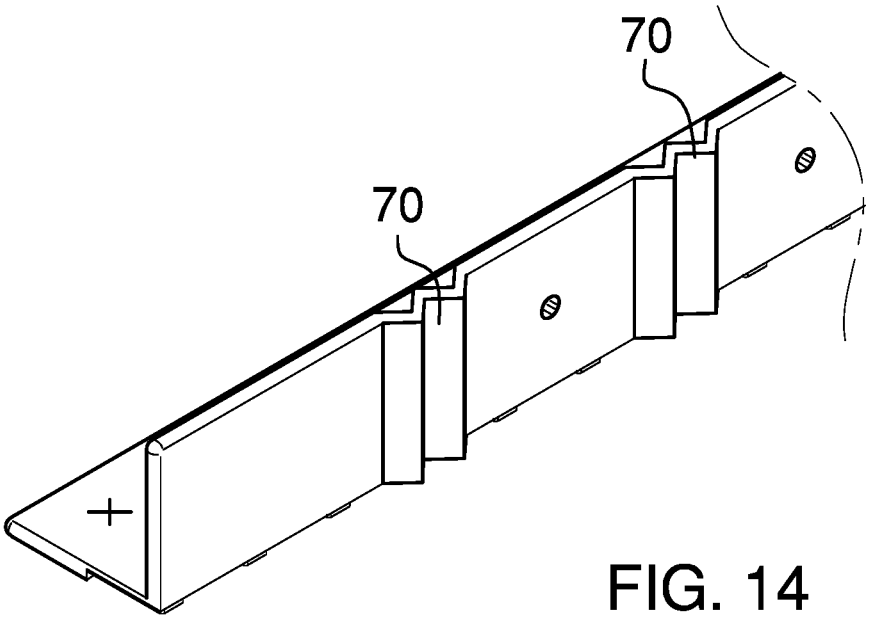
FIG. 14 is a fragmented isometric view of the back side of the base member of a first alternative embodiment, which allows the base member to lie flat over curved ground.

In the second embodiment, an expander 70 is added to the vertical sections of each base member, which can be seen in FIG. 13 and FIG. 14. The expanders 70 will permit the vertical members to bow to accommodate the topography where the ground is uneven.

Third Embodiment

Figure 15:
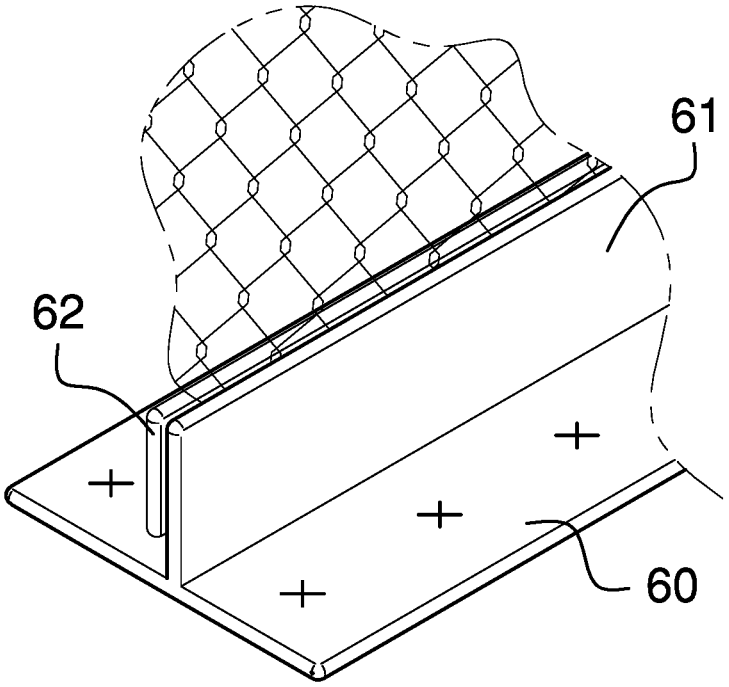
FIG. 15 is an isometric view of a second alternative embodiment.
Figure 16:
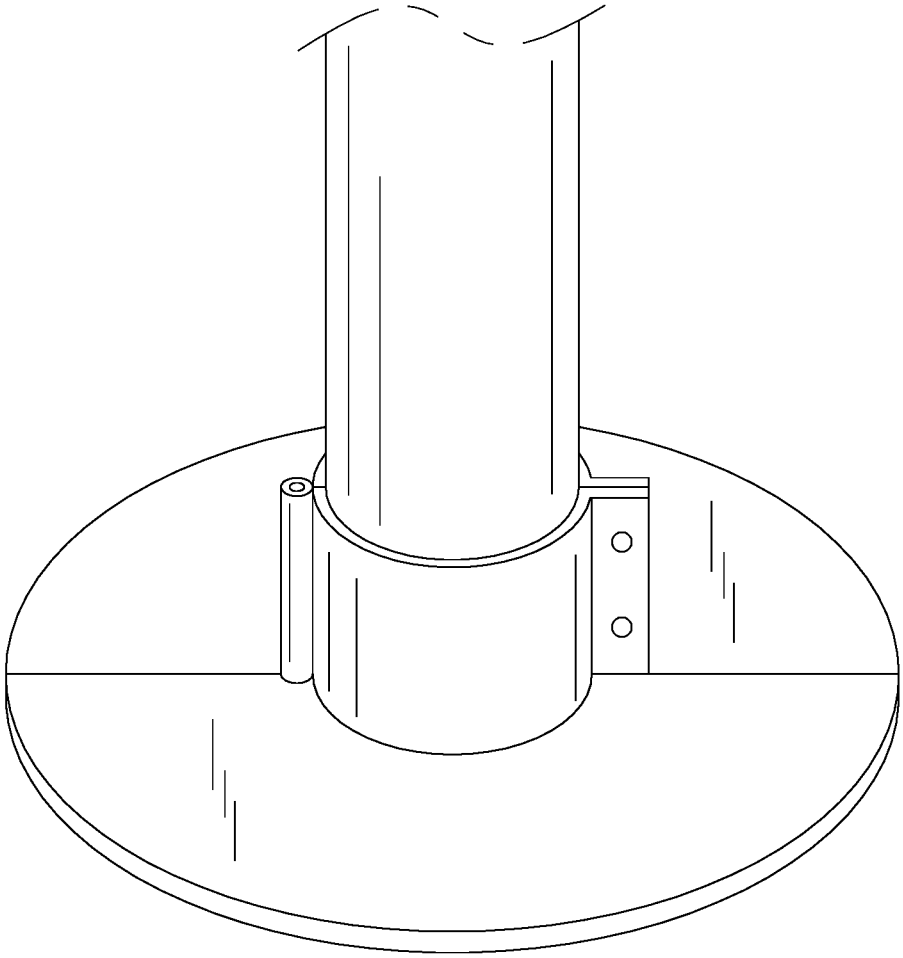
FIG. 16 is a front view of an alternative circular base section for a fence post with a clamp sitting atop the circular base section and surrounding the post of the fence.

In a third embodiment, the slot and tab are not used such as depicted in FIG. 15. Instead, there is a single member 60 that is comprised of horizontal section of predetermined dimensions and a vertical member of predetermined height. A separate vertical section 62 is placed along one side of the fence and is secured to the vertical member 61 of the corresponding single member 60. The strip section 62 is connected to the vertical member 61 with a nut and bolt assembly similarly to the other embodiments covered within this disclosure.

The third embodiment will prevent water from pooling as a gap is created between the end of the vertical member 61 and the top section of the single member 60.

Fourth Embodiment

In the fourth embodiment, an expander 70 is added to the vertical section 61 and horizontal strip 62 (not depicted). The expanders 70 will permit the vertical members to bow to accommodate the topography where the ground is uneven.

Figure 6:
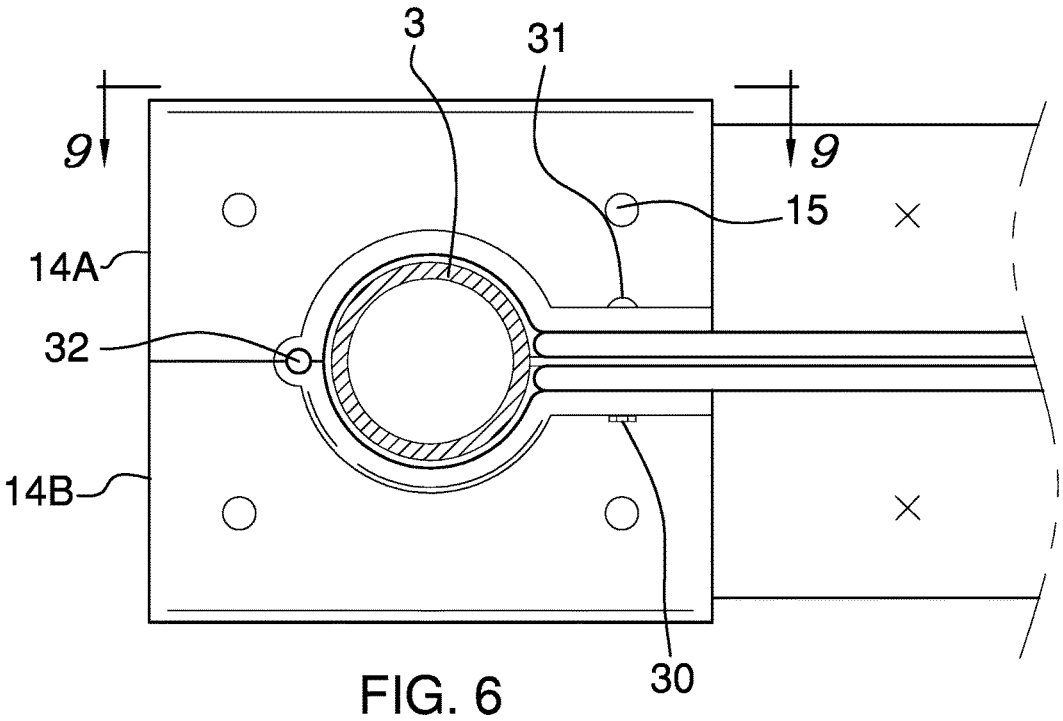
FIG. 6 is a top view of the base members and top end post sections that are surrounding an end post of a fence.

Each of the four embodiments will require additional attachments that provide material to cover areas next to or around line posts and end posts. Typically, the end post 3 is positioned so that the chain link fence runs to the middle of the post. A first end post base 14*a* and a second end post base 14*b* are provided specifically for end posts 3, which is also shown in FIG. 6. Pieces 14*a* and 14*b* mate together around the post with a hinge and rod connection 32 and at least one bolt and nut connection to prevent grass from growing up the respective end post. The first and second end post bases, 14*a* and 14*b* respectively, will determine the end of the fencing. The 14*a* and 14*b* bases also secure the ends of any of the disclosed base members, which can be seen in FIG. 6.

Figure 7:
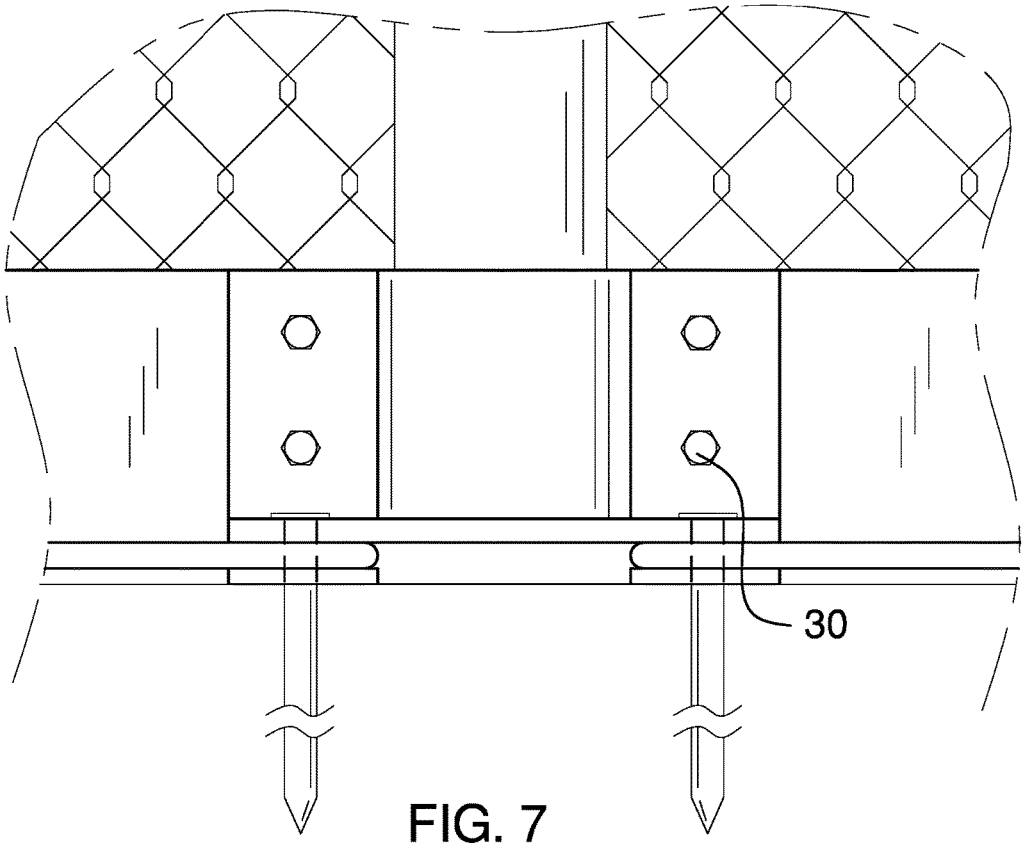
FIG. 7 is a front view of two base member sections, a first top line post section and a bottom line post section secured to each other and around the line post.
Figure 8:
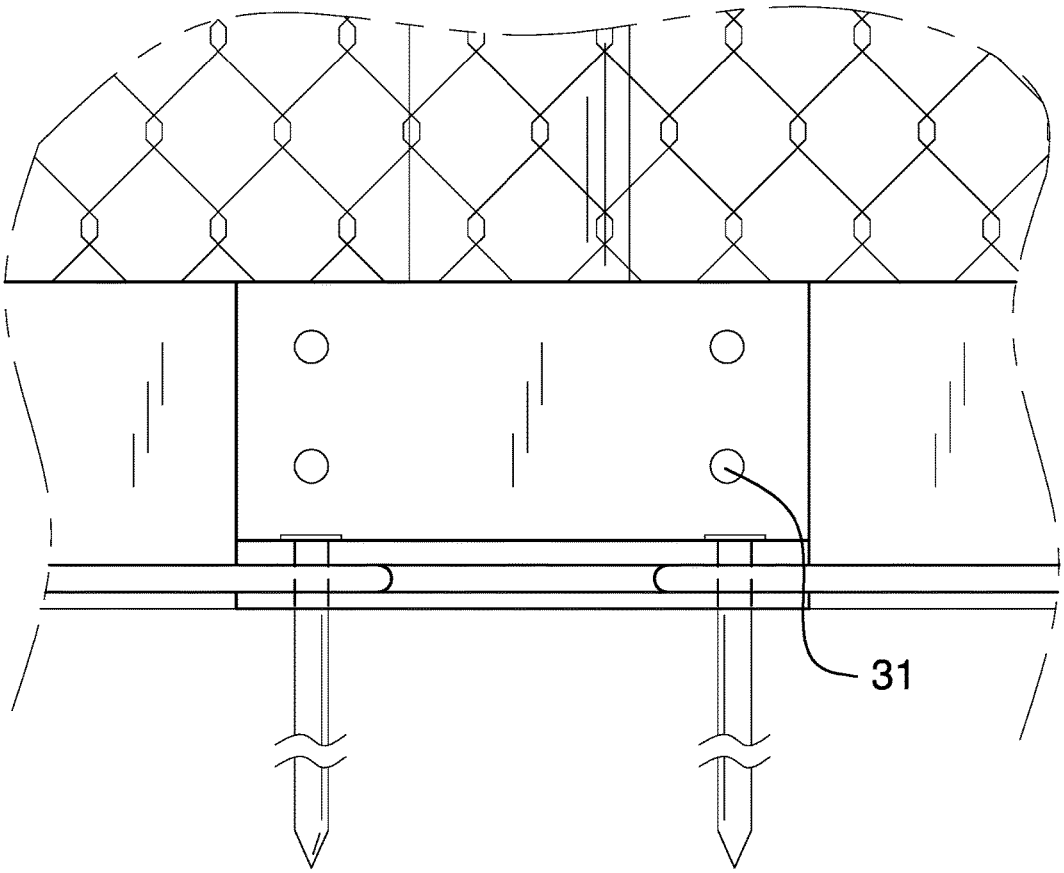
FIG. 8 is a back view of two base member sections, a second top line post section and the bottom line post section secured to each other around the line post.
Figure 9:
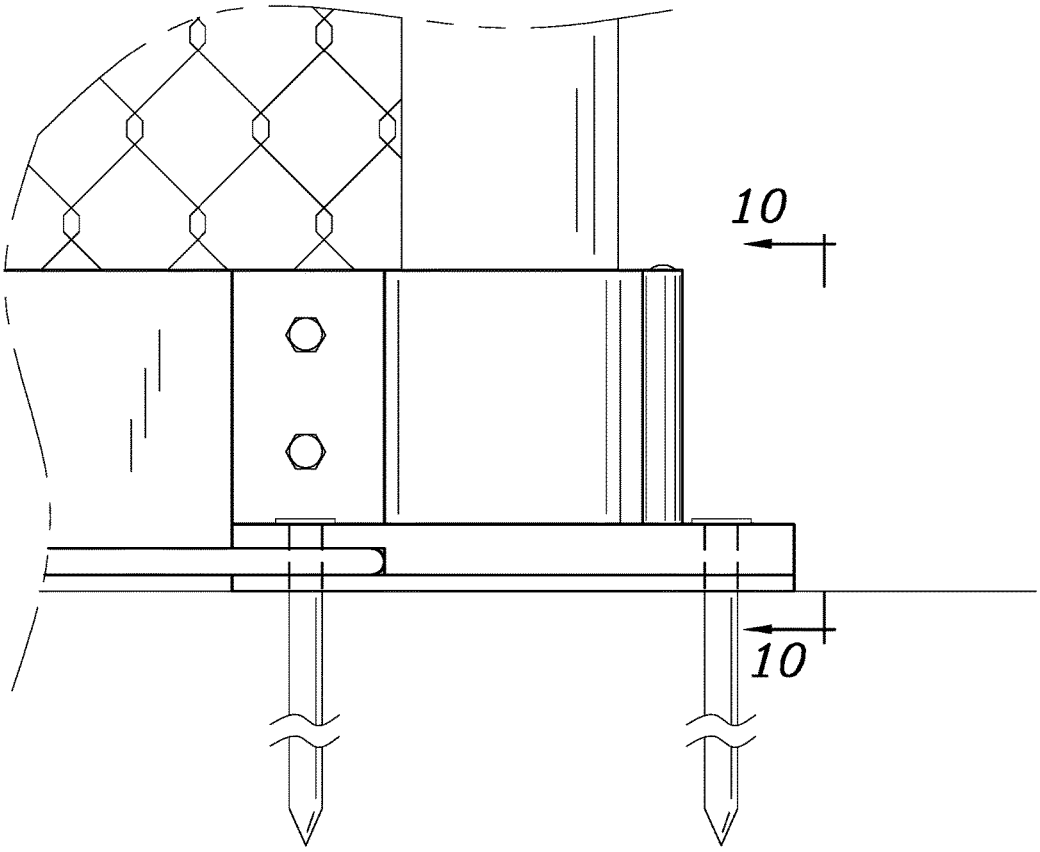
FIG. 9 is a front view of the means to secure the device to an end post at the end of a fence.
Figure 10:
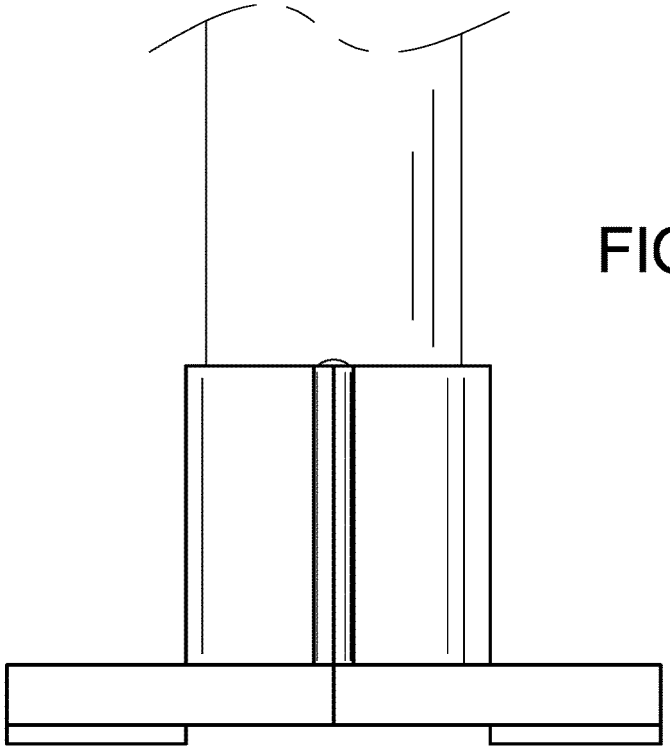
FIG. 10 is a side view of the base members attached to an end post.

With regards to line posts, they are typically on only one side of the fence, which can be seen in FIGS. 5, 7 and 8. A first line post base 12A and a second line post base 12B are provided specifically for line posts 2. Both line post bases, 12A and 12B, have a plurality of holes 15, and an integrated vertical section. The vertical section provided on base 12A spans partially around the line post 2 and overlaps on both sides with an adjacent base member 10 or 20. The vertical section provided on base 12B is flat and runs parallel to the fence. The plurality of holes 15 allows spikes to be easily inserted and placed into the ground for securement of the line post bases.

The second line post base 12B is provided on the opposing side of the line post 2 of first line post base 12A. The two line post bases connect together with bolt and nut assemblies with can be seen in FIGS. 5, 7 and 8. The ends of the base members for any of the embodiments are to be secured between portions of the two line post bases, which can be seen in FIG. 5.

Figure 12A:
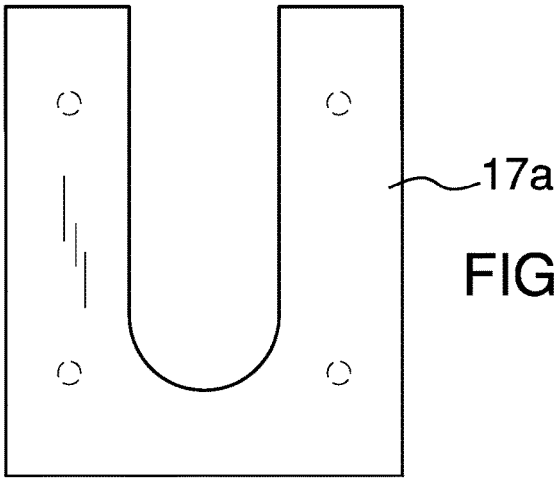
FIG. 12A is a top view of a line post base member.
Figure 12B:
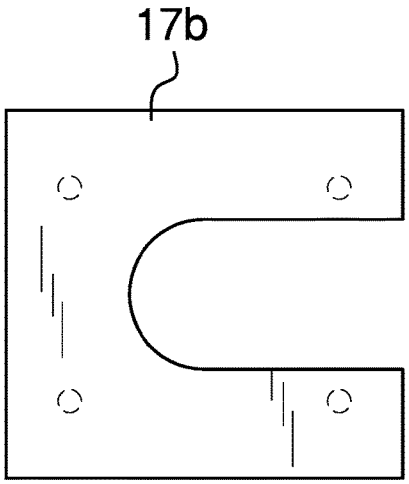
FIG. 12B is a top view of an end post base member.
Figure 12C:
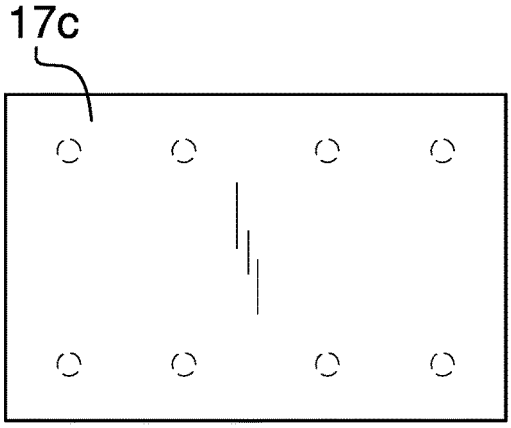
FIG. 12C is a top view of a rectangular base member.
Figure 17:
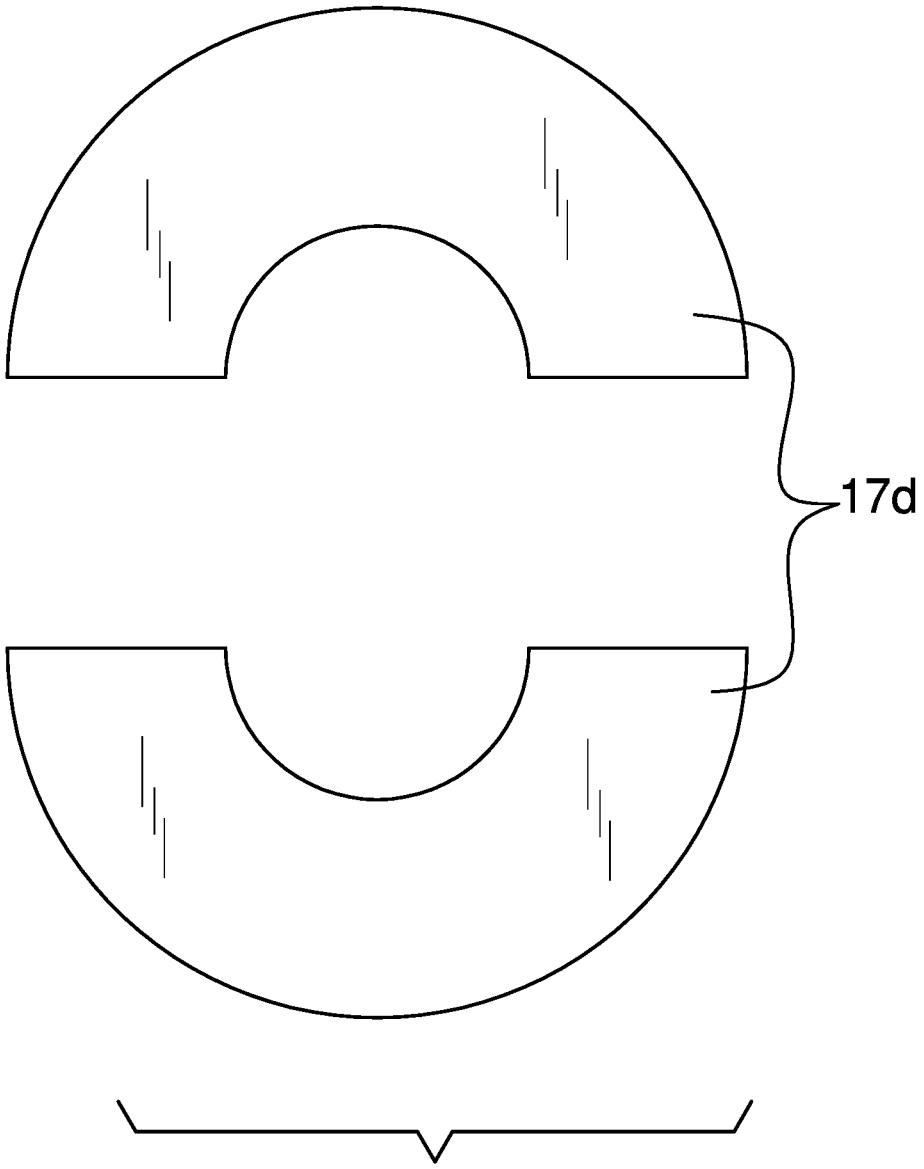
FIG. 17 is a top exploded view of the alternative circular base section.

FIG. 12 and FIG. 17 show ground cover sections. These sections are intended to offer additional ground coverage to further prevent grass or weed growth near fence line. These sections are to be placed under any of the base members described herein and can be seen in FIG. 7, FIG. 8, FIG. 9, FIG. 10, FIG. 12, FIG. 16, and FIG. 17.

Figure 11:
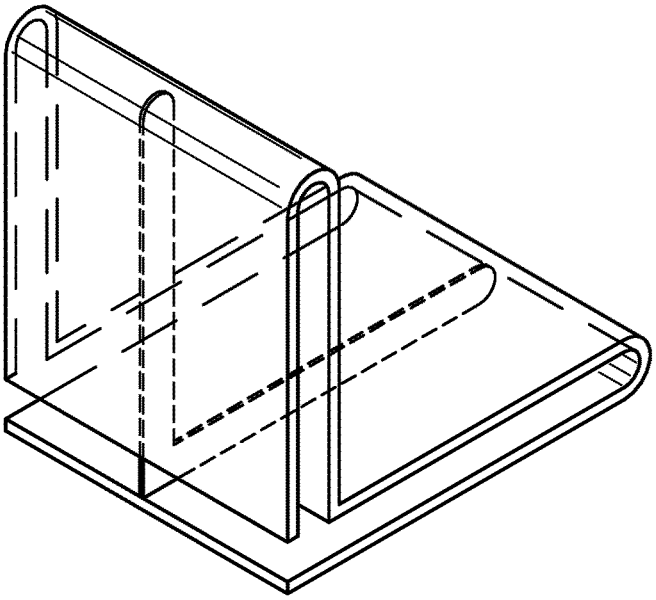
FIG. 11 is an isometric view of a portion of a coupling to adjoin an end of one base member to an end of another base member.

A base member coupling is also provided to adjoin one base member to another in the event the distance between fence posts is longer than the length of a base member. The base member coupling is shown in FIG. 11.

Because the fencing material will be outside, the material that will be used for this device should be resistant in all environmental conditions and should not decay or rust.

The inventor claims:

1. A fence trim guard which is comprised of:

a. a first base member;
  wherein the first base member has a horizontal surface and a vertical surface;
  wherein the vertical surface of the first base extends a predetermined distance above the horizontal surface of the first base;

b. a second base member;
  wherein the second base member has a horizontal surface and a vertical surface;
  wherein the vertical surface of the second base member extends a predetermined distance above the horizontal surface of the second base member;

c. an extension;
  wherein the extension is provided on the first base member;

d. a slot;
  wherein a lip is provided on the bottom of the second base member;

e. a plurality of spike holes—provided on the horizontal surface of the first base member and on the surface of the second base member;

f. a plurality of ribs;
  wherein the plurality of ribs are placed on the underside of the horizontal surface of the first and second base members;

g. a plurality of expanders;
  wherein the plurality of expanders is formed as part of the first base member;
  wherein the expander is integral to the vertical surface of the first base member;
  wherein the plurality of expanders is formed as part of the second base member;
  wherein the plurality of expanders is integral to the vertical surface of the second base member;
  wherein each expander permits its respective base member to bow.

2. A fence trim guard as described in claim 1 wherein the first base member is connected to a subsequent first base member with a base member coupling.

3. A fence trim guard as described in claim 1 wherein the second base member is connected to a subsequent second base member with a base member coupling.

4. A fence trim guard as described in claim 1 wherein the vertical surface of the first base member has at least one expander.

5. A fence trim guard as described in claim 1 wherein the vertical surface of the second base member has at least one expander.

* * * * *